US009192239B2

(12) United States Patent
Besler et al.

(10) Patent No.: US 9,192,239 B2
(45) Date of Patent: Nov. 24, 2015

(54) SEATING FURNITURE STRUCTURE AND ITEM OF SEATING FURNITURE

(71) Applicants: Boris Besler, Guetersloh (DE); Andreas Hortig, Halle (DE)

(72) Inventors: Boris Besler, Guetersloh (DE); Andreas Hortig, Halle (DE)

(73) Assignee: KINTEC-SOLUTION GMBH, Rietberg (DE)

( * ) Notice: Subject to any disclaimer, the term of this patent is extended or adjusted under 35 U.S.C. 154(b) by 0 days.

(21) Appl. No.: 14/268,040

(22) Filed: May 2, 2014

(65) Prior Publication Data

US 2014/0333111 A1 Nov. 13, 2014

(30) Foreign Application Priority Data

May 8, 2013 (DE) ..... 10 2013 208 562

(51) Int. Cl.
*A47C 7/50* (2006.01)
*A47C 1/035* (2006.01)

(52) U.S. Cl.
CPC ..... *A47C 7/506* (2013.01); *A47C 1/035* (2013.01)

(58) Field of Classification Search
CPC ..... B60N 3/06; A47C 7/506; B64D 11/0643
USPC ..... 297/423.28, 423.3, 423.36
See application file for complete search history.

(56) References Cited

U.S. PATENT DOCUMENTS 156,004 A * 10/1874 Wayland ..... 297/423.3
4,336,965 A * 6/1982 Lipp ..... 297/423.36
6,095,610 A * 8/2000 Okajima et al. ..... 297/423.36
6,227,489 B1 * 5/2001 Kitamoto et al. ..... 244/118.5
7,121,627 B2 * 10/2006 Gaikwad et al. ..... 297/423.36
8,573,696 B2 * 11/2013 Kuno ..... 297/284.11
2006/0186721 A1 * 8/2006 Flory et al. ..... 297/423.36

FOREIGN PATENT DOCUMENTS

DE 20 2004 011 998 U1 11/2004

OTHER PUBLICATIONS

Form PCT/ISA/220 Notification of Transmittal of International Search Report issued in International Application No. PCT/EP2014/059267 dated Jul. 18, 2014 (1 page).
Form PCT/ISA/210 International Search Report issued in International Application No. PCT/EP2014/059267 with English translation of categories of documents cited dated Jul. 18, 2014 (5 pages).
Form PCT/ISA/237 Written Opinion of International Searching Authority dated Jul. 18, 2014 (5 pages).

* cited by examiner

*Primary Examiner* — Peter Brown
(74) *Attorney, Agent, or Firm* — Flynn, Thiel, Boutell & Tanis, P.C.

(57) ABSTRACT

A seating furniture structure having a carrier unit and a seat part arrangement movably mounted relative to the carrier unit, and a leg rest arrangement with a guiding part and a support carriage displaceable relative to the guiding part by mechanical tension cord control system. The tension cord control system has a forced coupling to a pivot mechanism of the guiding part such that the support carriage is displaceable between different end positions relative to the guiding part in response to a pivot position of the guiding part.

The tension cord control system includes adjacent deflection elements, wherein a tension cord of the tension cord control system is guided alternatingly deflected in opposite directions over the deflection elements, and a deflection element is dislocatably retained and is in operative connection to the pivot mechanism of the guiding part by a forced coupling unit.

11 Claims, 9 Drawing Sheets

SEATING FURNITURE STRUCTURE AND ITEM OF SEATING FURNITURE

The invention relates to a seating furniture structure having a carrier unit and having a seat part arrangement movably mounted relative to the carrier unit, and having a leg rest arrangement which comprises a guiding part pivotably mounted relative to the carrier unit and/or to the seat part arrangement around a transverse axis of the seat and a support carriage displaceable relative to the guiding part by means of at least one mechanical tension cord control system, wherein the tension cord control system has a forced coupling to a pivot mechanism of the guiding part in such a manner that the support carriage is displaceable between different end positions relative to the guiding part in response to a pivot position of the guiding part.

Such a seating furniture structure is disclosed in DE 20 2004 011 998 U1. The well-known seating furniture structure is part of a chair which comprises a back rest pivotable relative to a seat surface and a leg support (leg rest) adapted to swing out. The seating furniture structure includes a carrier unit mounted on a stand, whereon a seat part arrangement is retained approximately horizontally displaceable. On the rear side, the seat part arrangement is flanked by a back rest arrangement. On the front side, the seat part arrangement is adjoined by a leg rest arrangement which comprises a pivotably retained guiding part. The guiding part is pivotably mounted around a seat transverse axis between an idle position pivoted below the seat part arrangement and a functional position projecting forward in extension of the seat part arrangement. On the guiding part, a support carriage is guided to be displaceable in linear motion, the carriage in the deployed end position defining a long support surface for the leg rest arrangement. In retracted, displaced towards the seat part arrangement, position of the support carriage the leg rest arrangement has a least possible length. Variation of the length of the leg rest arrangement is useful to allow pivoting of the leg rest arrangement below the seat part arrangement, without striking a floor or the stand of the chair when in a vertically downwards projecting intermediate position. For displacing the support carriage during said pivoting movement of the leg rest arrangement from the functional position downwards to the idle position, the support carriage is associated a tension cord control system including a tension strap engaging the support carriage, which strap is guided in a loop up to a rear end of the seat part arrangement and is there deflected via a deflection pulley to return to the front. The end section is fixed on a front cross-member of the seat part arrangement. The deflection pulley is displaced via a lever arm and a sliding link motion in response to the pivot position of the guiding part.

An object of the invention is to provide a seating furniture structure of the above mentioned type which allows a compact design of a tension cord control system for the support carriage and a large adjusting range of the support carriage.

The object is achieved for a seating furniture structure of the above mentioned type in that the tension cord control system includes a plurality of adjacent deflection elements, wherein a tension cord of the tension cord control system is guided alternatingly deflected in opposite directions over the deflection elements, and at least one deflection element is dislocatably retained and is in operative connection to the pivot mechanism of the guiding part by means of a forced coupling unit. Deflection in opposite directions of the tension cord around adjacent deflection elements allows a compact design of the tension cord control system and equally a large travel distance for a displacement travel of the support carriage. Preferably, the support carriage is mounted movable in linear motion relative to the guiding part. It is also possible, to displace the support carriage by means of a parallel guider arrangement approximately in parallel relative to the guiding part. Even displaceability of the support carriage relative to the guiding part along a curved track is comprised by the solution according to the invention. Preferably, deflection pulleys or deflection rollers are provided as deflection elements. It is also possible, to provide deflection bodies as deflection elements, whereon the tension cord is deflected in a sliding movement. The plurality of adjacent deflection elements is to be conceived as at least two deflection elements, and the tension cord is deflected in opposite directions over them. With more than two adjacent deflection elements, the tension cord is deflected alternatingly around the respective adjacent deflection elements. The tension cord provided is preferably a tension strap in the form of a fabric tape made of textile or synthetic material fibers. Instead of a tension strap, a tension rope or a tension belt can also be provided as a tension cord. It is possible, to control the support carriage merely by means of a single tension cord control system and by means of a single tension cord. In an advantageous manner, two tension cord control systems are provided that are designed to be mutually identical and spaced in the seat transverse direction and engage on opposite sides of the support carriage to thus effect synchronous and uniform longitudinal displacement, that is parallel displacement, of the support carriage relative to the guiding part. Advantageously, the support carriage is held in a deployed end position relative to the guiding part by means of a spring force arrangement, wherein the leg rest arrangement has its outmost longitudinal extension. The tension cord control system is active counter the spring force of the spring force arrangement, to displace the support carriage in the direction of the retracted end position relative to the guiding part. The solution according to the invention is in a particularly advantageous manner adapted to items of seating furniture that are provided with an upholstery in the region of the seat part arrangement and the leg rest arrangement. The carrier unit of the seating furniture structure is either propped up directly on a ground in the type of a carrier frame, or it is swivel-mounted around a vertical axis of rotation on a stand frame, wherein the stand frame is sitting on a respective ground. In a particularly advantageous manner, the seating furniture structure comprises a back rest arrangement adjoining the seat part arrangement on the rear side, wherein the back rest can be retained readjustable in its inclination relative to the carrier unit and/or relative to the seat part arrangement.

For readjusting of the seat part arrangement and the leg rest arrangement and/or the back rest arrangement, at least one, preferably electromotive, actuation unit can be associated to the seating furniture structure, and advantageously the actuation unit is fixed on the carrier unit. It is also possible, for readjusting the seat part arrangement on the one hand and readjusting an associated back rest arrangement on the other hand, to provide two different, preferably electromotive, actuation units. A corresponding electromotive actuation unit has, in addition to an electric motor, an appropriate gearing mechanism and drive transmission means in operative connection to the seat part arrangement and/or the back rest arrangement.

In an embodiment of the invention, the tension cord is fixed with one end section on the carrier unit and with its opposite end section on the support carriage. Preferably, the carrier unit comprises a cross-member extending in the transverse direction of the seat, and one end section of the tension cord is fixed to the cross-member. In case two mutually identical tension cord control systems are provided, there is also an end section of the second tension cord of the second tension cord control system fixed to said cross-member.

In another embodiment of the invention, the tension cord control system is arranged adjacent to the pivot mechanism of the guiding part in a front section of the carrier unit facing the guiding part. Thereby, a compact accommodation of the tension cord control system is permitted, whereby a compact length of the tension cord and short deflection distances for the tension cord can be achieved.

In another embodiment of the invention, two adjacent deflection elements are arranged on opposite legs of a rocker pivotably mounted around a central rocker axis. The deflection elements are each mounted at an equal distance to the central rocker axis on the opposite legs of the rocker. Preferably, deflection rollers are provided as deflection elements. The tension cord is deflected via the adjacent deflection elements of the rocker in opposite directions, in that the cord is guided over the deflection rollers on one deflection roller in a first sense of rotation and on the second deflection roller in an opposite sense of rotation. By turning the rocker, a looping angle of the tension strap on the deflection rollers is varied necessarily—according to the turning direction of the rocker—whereby necessarily a more or less extended length of the tension cord is guided over the deflection rollers of the rocker. Accordingly, the support carriage is necessarily varied in its position relative to the guiding part due to the tensional force of the tension cord.

In another embodiment of the invention, a stationary deflection element is arranged on the carrier unit. Preferably, a deflection roller is provided as stationary deflection element, which roller is rotatably mounted around a rotary axis that is stationary on the carrier unit.

In another embodiment of the invention, a deflection element adjacent to the support carriage is mounted on a pivot lever which is in operative connection to the pivot mechanism of the guiding part. Also the deflection element adjacent to the support carriage is preferably a deflection roller and rotatably mounted on an end section of the pivot lever. All of the deflection rollers of the tension cord control system have mutually parallel axes of rotation.

In another embodiment of the invention, the tension cord is guided starting from its end section, that is fixed to the carrier unit, alternatingly deflected in opposite directions over the two deflection elements of the rocker, over the stationary deflection element and finally over the deflection element mounted on the pivot lever, and ends in an end section fixed on the support carriage. Thereby, the tension cord is deflected in the type of a leporello alternatingly over the various deflection elements. Owing to the readjustability of the deflection elements on the rocker and on the pivot lever, variation of the looping angles of the tension cord on the different deflection elements is necessarily achievable, whereby the support carriage is displaced in parallel relative to the pivotable guiding part of the leg rest arrangement, due to the corresponding elongation or reduction of the control section of the tension cord between the last deflection element disposed on the pivot lever and the attachment point on the support carriage.

In another embodiment of the invention, the forced coupling unit is control lever kinematics provided for forced coupling of the tension cord control system to the pivot mechanism of the guiding part, in order to couple the pivot lever, bearing the deflection element adjacent to the support carriage, to the rocker in such a manner that the support carriage assumes its rear side end position displaced relative to the seat part arrangement in a downwards projecting, in particular perpendicular to a ground, pivot position of the guiding part. Said embodiment is based on the finding that upon pivoting the leg rest arrangement downwards below the seat part arrangement the distance present between a bottom side of the seat part arrangement and a ground, where the seating furniture structure is placed on, is not so great in order that the leg rest arrangement can be pivoted, while the support carriage is deployed in its forward extended end position, without touching the ground. Using the control lever kinematics, the tension cord control system controls the support carriage, due to the mechanical coupling to the pivot mechanism of the guiding part, in such a way that the support carriage assumes its completely retracted end position, with the guiding part in a corresponding position projecting downward towards the ground.

In another embodiment of the invention, the control lever kinematics comprise a control arm engaging the pivot lever and a double lever mounted on the carrier unit, wherein the control arm engages the double lever. The control arm and the double lever constitute a kinematic chain between the pivot lever of the tension cord control system and the rocker of the tension cord control system. Advantageously, the double lever is coupled to the rocker of the tension cord control system by means of a transfer lever. The transfer lever is also a component in the kinematic chain of the control lever kinematics in order to obtain forced coupling to the tension cord control system.

The invention also relates to an item of seating furniture having a seating furniture structure, as explained with reference to at least one of the above described paragraphs. Preferably, the item of seating furniture provided is a chair, including upholstery parts that cover and/or enclose the seating furniture structure at least partially.

Further advantages and features of the invention will become apparent from the claims and also from the following description of a preferred exemplary embodiment of the invention, illustrated in the Figures:

Figure 9:
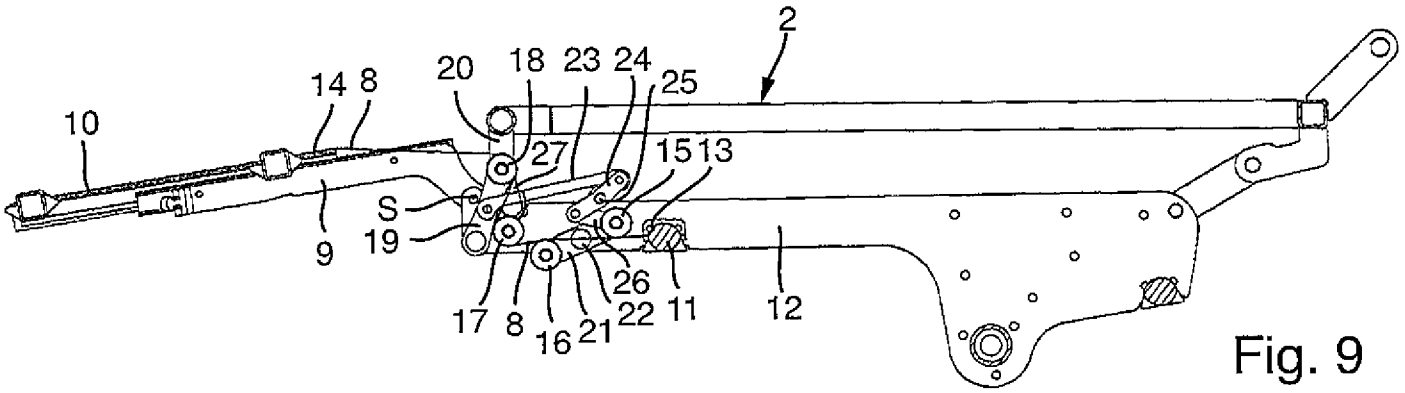
Figure 10:
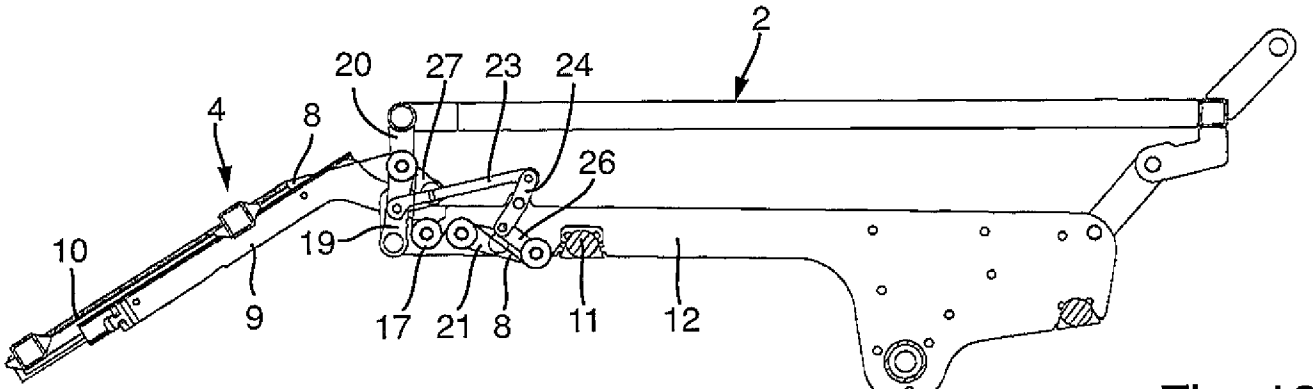
Figure 11:
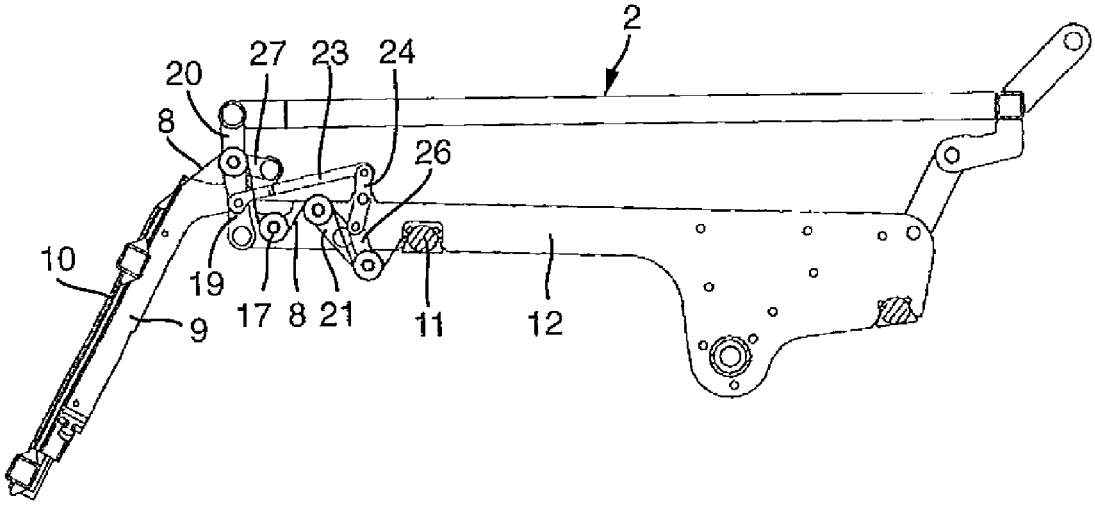
Figure 15:
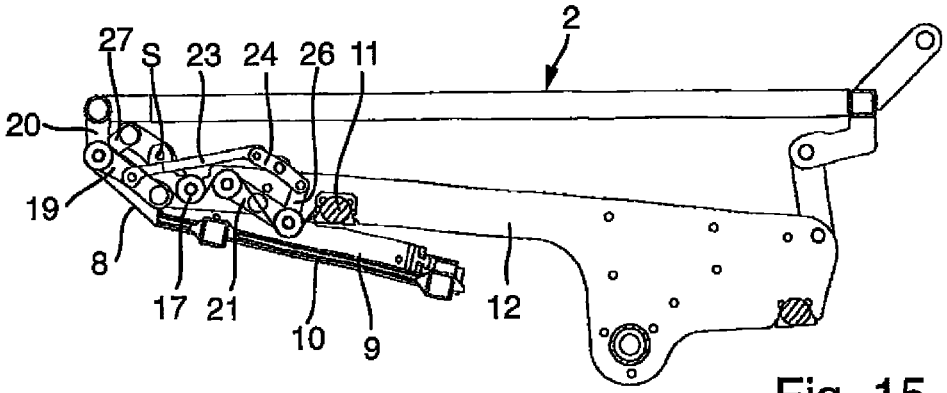

FIG. 9 shows schematically a side view as seen from the interior of the seating furniture structure according to FIGS. 2 to 8 in an extended support position of the leg rest arrangement; and FIGS. 10 to 15 show the seating furniture structure according to FIG. 9 in different functional positions of the leg rest arrangement during its transfer to an end position stored below the seat part arrangement (FIG. 15).

A seating furniture structure, as detailed with reference to FIGS. 1 to 15 hereinbelow, is part of a chair which may be readjusted between an upright sitting position and a reclined position. The seating furniture structure includes a carrier unit 5 which is stationarily mounted on a stand frame not illustrated in detail. The carrier unit 5 can be rotatably mounted around a vertical axis relative to the stand frame so that the entire seating furniture structure can be swiveled around said vertical axis relative to the stand frame. Accordingly, the seating furniture structure is part of a swivel chair.

The seating furniture structure includes a seat part arrangement 2 which can be readjusted relative to the carrier unit 5 by means of lever kinematics, not designated in detail, essentially in parallel to the seat surface plane in the longitudinal direction of the seat. In addition, there is a back rest arrangement 3 mounted on the seat part arrangement 2 and on the carrier unit 5, which back rest can be readjusted in its inclination relative to the carrier unit 5 and relative to the seat part arrangement 2. Both for readjusting the back rest arrangement 3 and for displacing the seat part arrangement 2, there is in each case an electromotive actuation unit provided and mounted on the carrier unit 5.

The carrier unit 5 has two lateral longitudinal beams 12 extending in parallel one to the other and interconnected via a cross-member 11 in a front leg portion. The cross-member 11 is also part of the carrier unit 5. On a front end section of the longitudinal beams 12, a leg rest arrangement 4 is pivotably mounted on the carrier unit 5. The leg rest arrangement 4 is pivotably mounted around a pivot axis S (FIG. 3) extending in the seat transverse direction. Moreover, the leg rest arrangement 4 is in operative connection to the lever kinematics for readjusting the seat part arrangement 2 via two control levers 27. The leg rest arrangement 4 includes a pivotable guiding part 9 mounted on the longitudinal beams 12 around the pivot axis S and articulated to the control levers 27 by control tabs projecting on the rear side. A support carriage 10 is mounted on the guiding part 9 to be displaceable in linear motion. The support carriage 10 is held in a deployed end position relative to the guiding part 9 by means of a spring force arrangement (not illustrated) in an unloaded condition, according to FIG. 2, wherein the support carriage 10 is shifted forwards relative to the guiding part 9 across from a front transverse profile of the seat part arrangement 2, up to an end stop on the guiding part 9.

Figure 1:
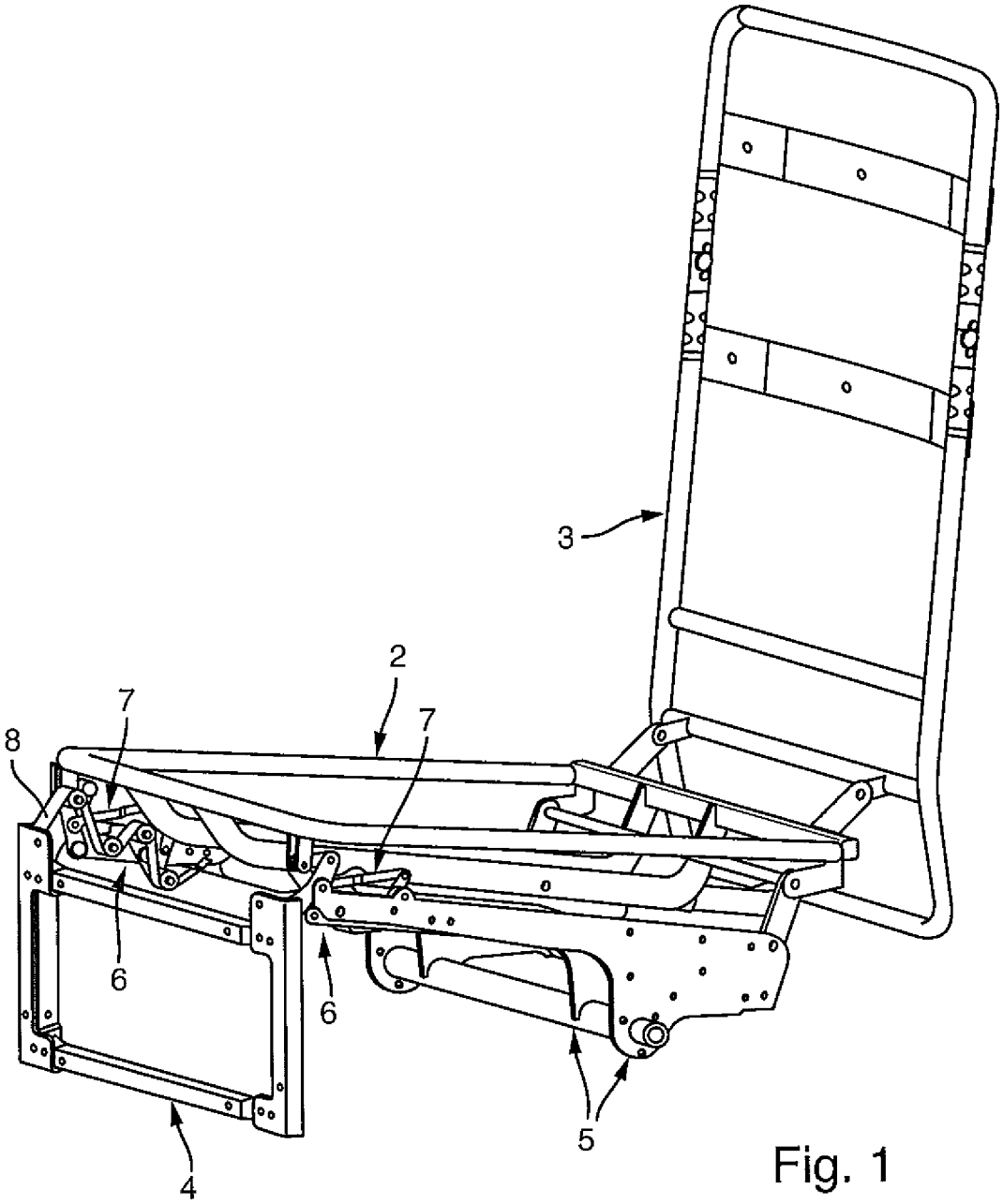
FIG. 1 shows an isometric illustration of an embodiment of a seating furniture structure according to the invention.
Figure 2:
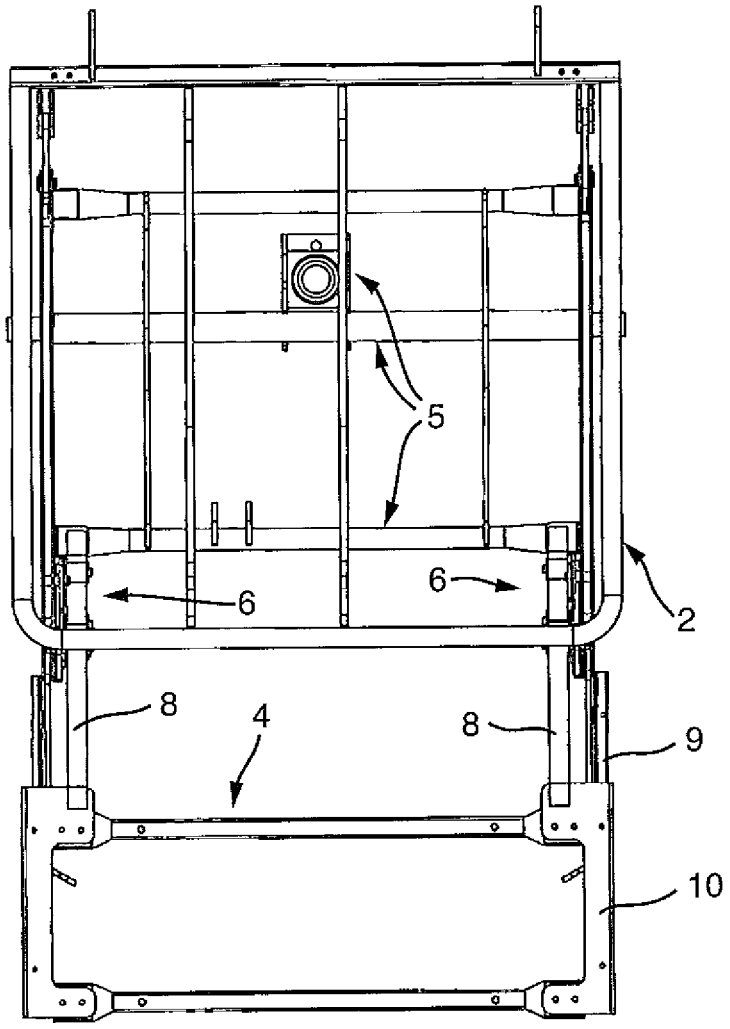
FIG. 2 shows a top view on the seating furniture structure according to FIG. 1, wherein a back rest arrangement is omitted.
Figure 3:
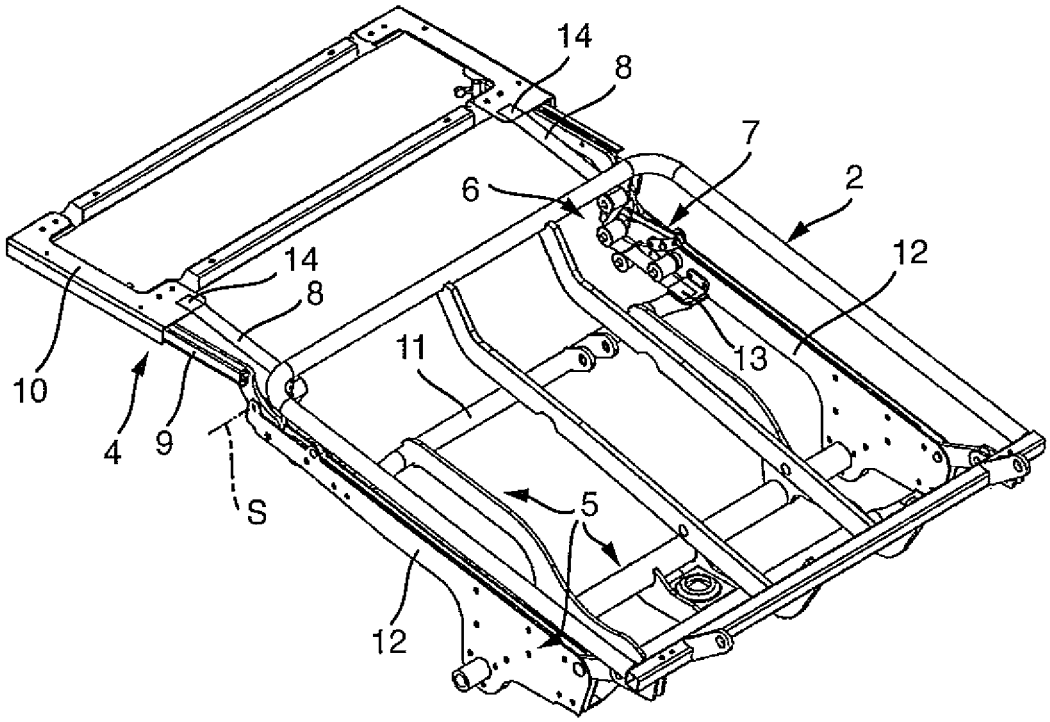
FIG. 3 shows an isometric illustration of the seating furniture structure according to FIG. 2 in oblique top view and rear view.
Figure 4:
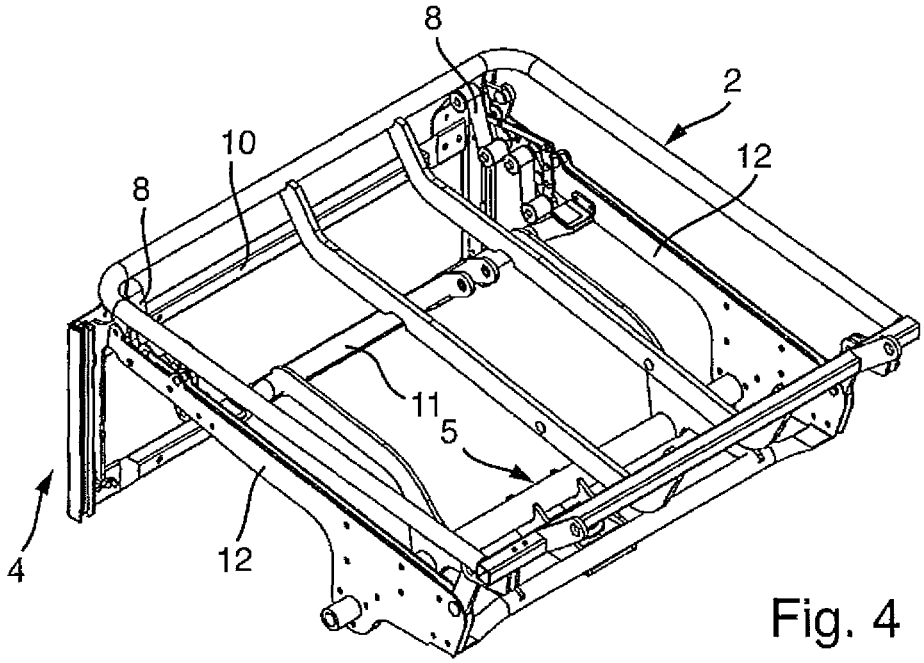
FIG. 4 shows the seating furniture structure according to FIG. 3 in another functional position.
Figure 5:
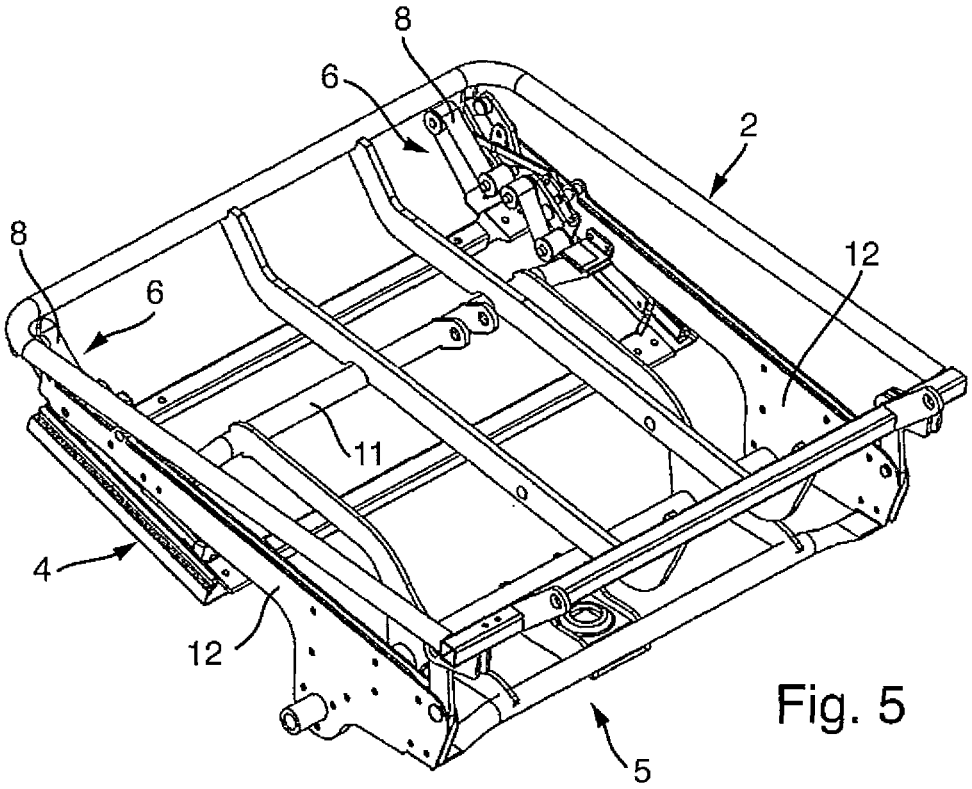
FIG. 5 shows the seating furniture structure according to FIGS. 2 to 4 in another functional position.

With reference to FIGS. 3 to 5, the leg rest arrangement 4 is pivotable, from an end position extending forwards in continuation of the seat part arrangement 2, downwards to a lower end position concealed below the seat part arrangement 2 (FIG. 5). In order to ensure that the leg rest arrangement 4, during transfer from the upper end position to the lower end position, does not strike the ground or the stand frame with the support carriage 10, the support carriage 10 is displaced relative to the guiding part 9 to a retracted idle position, namely its rear side end position, wherein the support carriage 10 is shifted in the direction towards the front transverse profile of the seat part arrangement 2. Displacing the support carriage 10 counter the spring force of the (not illustrated) spring force arrangement along respective guiding rails of the guiding part 9 is effected by two tension cord control systems 6 of identical design, which control systems are disposed on the interior side on front end sections of the longitudinal beams 12 of the carrier unit 5. The two tension cord control systems 6 are positioned below the seat part arrangement 2. Each tension cord control system 6 has a respective tension strap 8 fixed with its rear side end section 13 on the cross-member 11 of the carrier unit 5 and with its front end section 14 on the support carriage 10. The tension strap 8 is deflected between the two end sections 13 and 14 in a manner as detailed hereinbelow over a plurality of deflection rollers 15 to 18 in each case alternatingly in opposite directions, and thus in a leporello type deflection, wherein the tension strap 8 is deflected starting from the end section 13 fixed on the cross-member 11 initially in clockwise direction around a first deflection roller 15, subsequently counter-clockwise around a second deflection roller 16, then again clockwise around a third deflection roller 17, and finally counter-clockwise around a fourth deflection roller 18, as illustrated in FIGS. 6 to 15, before the tension strap 8 is fixed to the support carriage 10 by means of the end section 14. The opposite tension cord control system 6 has a design and configuration identical to that of the tension cord control system 6 illustrated in detail with reference to FIGS. 6 to 15 on the right hand side in a sitting line of sight. The only difference is that the left hand side tension cord control system 6 is mirror symmetrical to the right hand side tension cord control system 6, relative to a vertical central longitudinal plane of the seating furniture structure.

The two deflection rollers 15 and 16 are parallel one to the other rotatably mounted on opposite legs of a rocker 21, wherein the rocker is see-sawingly mounted by means of a pivot bearing 22 around a rocker axis parallel to the rotary axes of the deflection rollers 15 and 16 on the interior side of the longitudinal beam 12. The third deflection roller 17 is rotatably mounted around a rotary axis stationary relative to the longitudinal beam 12. The fourth deflection roller 18 is rotatably mounted on an upper end section of a pivot lever 19, wherein the pivot lever 19 is mounted on the longitudinal beam 12 with its lower pivot point and articulated on a support tab 20 with an upper pivot point, with the support tab projecting downwards from the seat part arrangement 2.

The guiding part 9 is articulated to the control lever 27 by means of a control extension projecting rearwards relative to the pivot axis S, the control lever 27 again being articulated to the support tab 20 and the bearing point of the pivot lever 19 by means of its adjacent pivot point. As a result, displacing the seat part arrangement 2 causes displacing of the leg rest arrangement 4 as well.

In order to couple the tension cord control system 6 with readjustment of the guiding part 9 of the leg rest arrangement 4 and with displacement of the seat part arrangement 2, control lever kinematics 7 are provided, comprising a control lever 23, also designated control arm, a double lever 24 and a transfer lever 26. The transfer lever 26 engages on the rocker 21 in the vicinity of the bearing point of the first deflection roller 15. The double lever 24 is see-sawingly mounted in the manner of a rocker around a bearing point 25 that is stationary to the longitudinal beam 12. The control lever 23 engages on a leg of the double lever 24 opposite to the transfer lever 26 and by its opposite pivot point the control lever is coupled to the pivot lever 19 below the fourth deflection roller 18.

Figure 6:
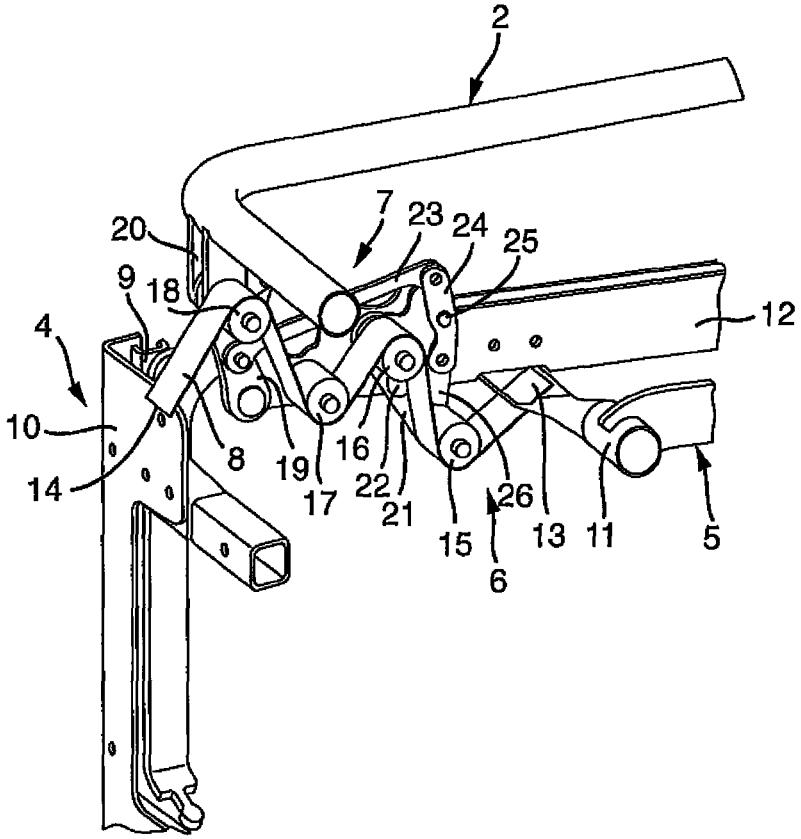
FIG. 6 shows an enlarged isometric illustration of a section of the seating furniture structure according to FIG. 1 in a front, lateral region of a seat part arrangement.
Figure 7:
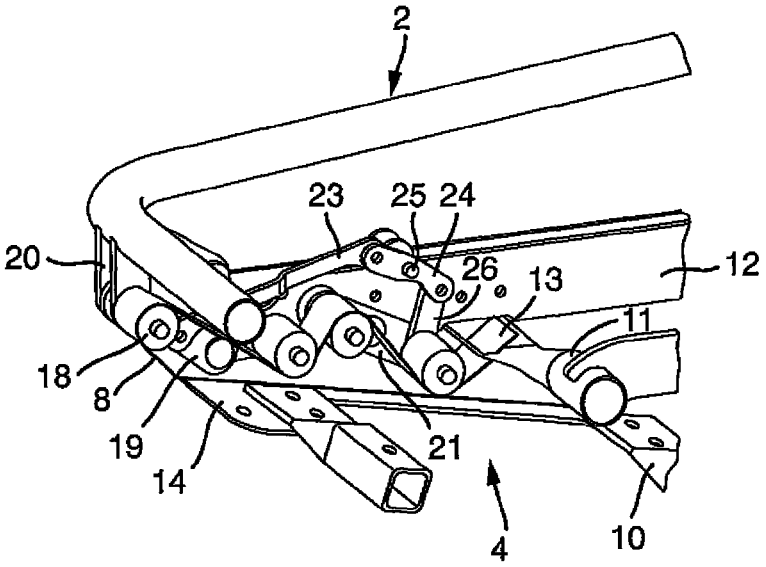
FIG. 7 shows the section according to FIG. 6 in another functional position of a leg rest arrangement.
Figure 8:
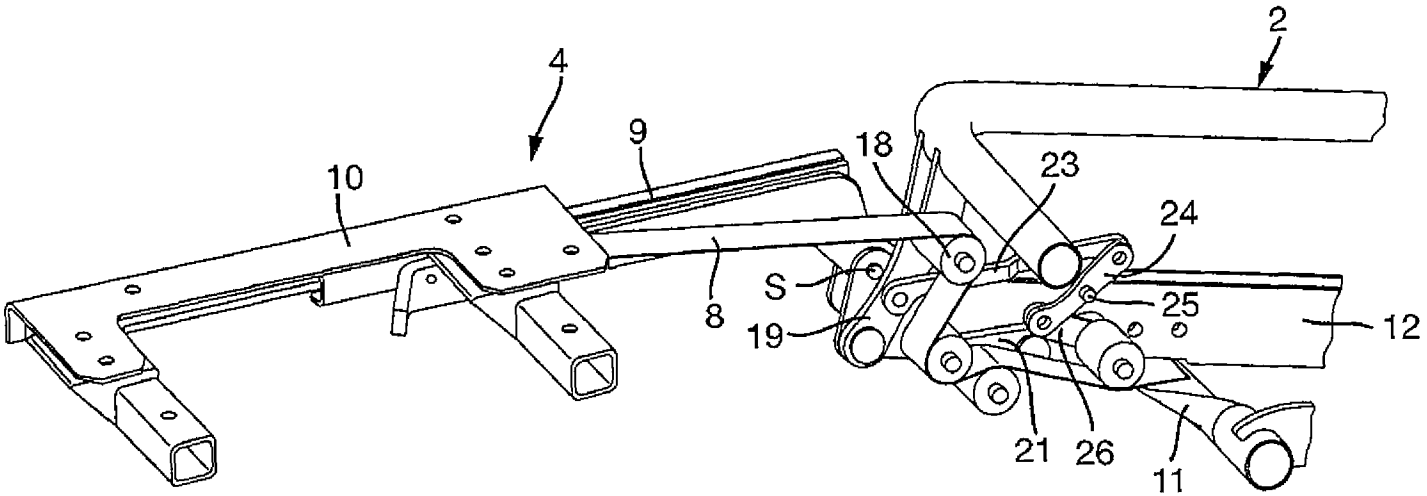
FIG. 8 shows the section according to FIGS. 6 and 7 with the leg rest arrangement shifted to an extended support position.
Figure 12:
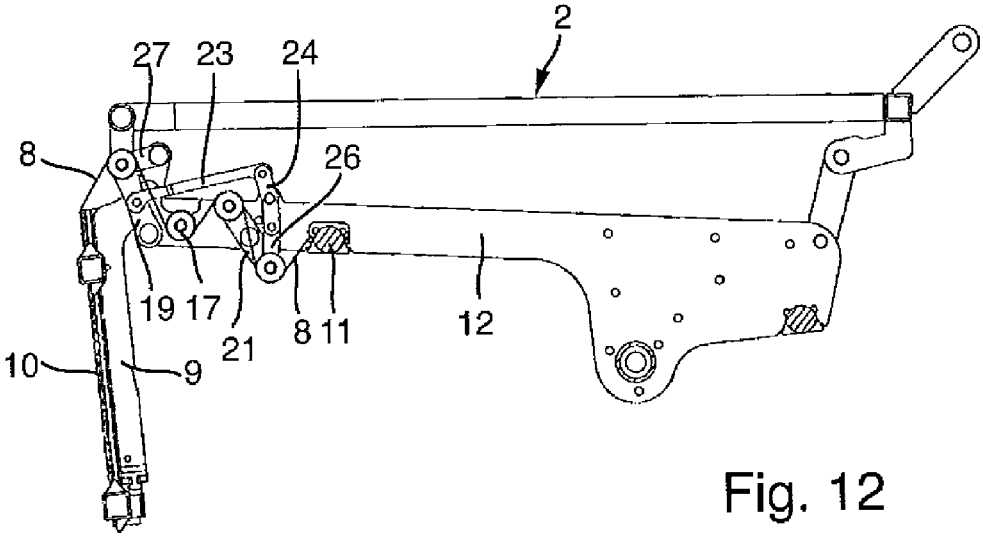
Figure 13:
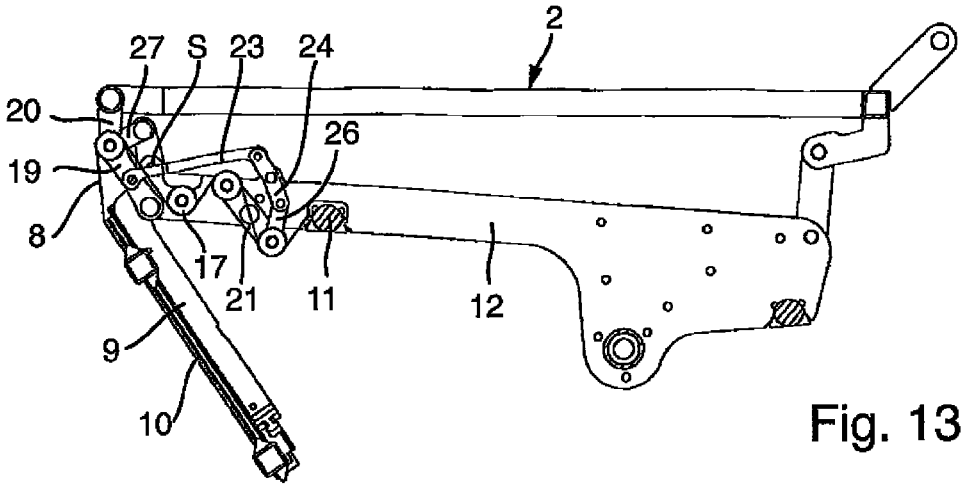
Figure 14:
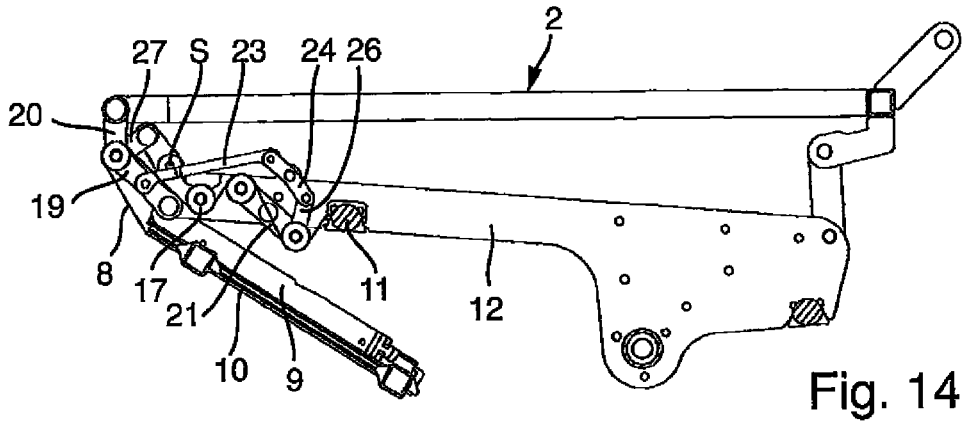

Upon pivoting the pivot lever 19 by displacing the seat part arrangement 2 and/or pivoting the guiding part 9 of the leg rest arrangement 4, a corresponding torque is transferred in the positive mode to the control lever 23 which acts on the double lever 24. The double lever 24 continues the kinematic chain on the transfer lever 26 which again cooperates with the rocker 21 and exerts a corresponding torque on the rocker 21. By means of appropriate pivoting of the pivot lever 19 and also by means of turning the rocker 21, the tension strap 8 necessarily assumes different looping angles on the different deflection rollers 15 to 18, with all of the rollers having mutually parallel rotary axes. As a result, the strap section of the tension strap 8 extending between the fourth deflection roller 18 and the end section 14 on the support carriage 10 is varied, whereby corresponding tensional forces are exerted on the support carriage 10 causing variation of the location of the support carriage 10 relative to the guiding part 9. With reference to FIGS. 9 to 15, the different levers of the tension cord control system 6 and the control lever kinematics 7 assume different positions between the upper end position of the leg rest arrangement 4 (FIGS. 3, 8 and 9) and the lower end position of the leg rest arrangement 4 (FIGS. 5, 7 and 15) during a progression between these two end positions. The tension cord control system 6 and also the associated control lever kinematics 7 are configured such that the support carriage 10 in a reference location, corresponding approximately to a vertically downwards projecting intermediate position, assumes an idle position, wherein the support carriage 10 is completely pushed over the guiding part 9 in a telescoping manner (FIG. 4, FIG. 6, FIG. 12). Respective lever ratios of the tension cord control system 6 and the control lever kinematics 7 can be determined with reference to FIGS. 9 to 15, since the FIGS. 9 to 15 are true to scale in that respect. The forced coupling of the tension cord control system 6 to the pivoting movement of the guiding part 9 and a displacing movement of the seat part arrangement 2 via the control lever kinematics 7 is effected in analogous manner during a swinging-out movement of the leg rest arrangement 4 from the lower end position to the upper, extended end position according to FIGS. 2, 3, 8 and 9.

The invention claimed is:

1. A seating furniture structure comprising a carrier unit, a seat part arrangement movably mounted relative to the carrier unit, and a leg rest arrangement, the leg rest arrangement comprising a guiding part pivotably mounted relative to the carrier unit and/or to the seat part arrangement for rotation around a transverse axis of the seat part arrangement, the leg rest arrangement further comprising a support carriage displaceable relative to the guiding part by at least one mechanical tension cord control system, wherein the tension cord control system is operatively coupled to a pivot mechanism of the guiding part in such a manner that the support carriage is forced between different end positions relative to the guiding part in response to a pivot position of the guiding part, wherein the tension cord control system includes a plurality of adjacent deflection elements, wherein a tension cord of the tension cord control system is guided and deflected in alternative opposite directions over adjacent ones of the deflection elements, and at least one of the deflection elements is dislocatably retained and is operatively connected to the pivot mechanism of the guiding part by a forced coupling unit.

2. The seating furniture structure according to claim 1, wherein the tension cord is fixed with one end section on the carrier unit and with an opposite end section on the support carriage.

3. The seating furniture structure according to claim 1, wherein the tension cord control system is arranged adjacent to the pivot mechanism of the guiding part in a front section of the carrier unit facing the guiding part.

4. The seating furniture structure according to claim 1, wherein the at least one of the deflection elements includes two adjacent deflection elements dislocatably retained and operatively connected to the pivot mechanism, the two adjacent deflection elements being arranged on opposite legs of a rocker pivotably mounted around a central rocker axis.

5. The seating furniture structure according to claim 4, wherein the plurality of adjacent deflection elements comprises a stationary deflection element arranged on the carrier unit.

6. The seating furniture structure according to claim 5, wherein the plurality of adjacent deflection elements comprises a deflection element adjacent to the support carriage and mounted on a pivot lever, the pivot lever being operatively connected to the pivot mechanism of the guiding part.

7. The seating furniture structure according to claim 6, wherein the tension cord is guided starting from a first end section thereof that is fixed to the carrier unit alternatingly deflected in opposite directions over the two adjacent deflection elements of the rocker, over the stationary deflection element and finally over the deflection element mounted on the pivot lever, and ends in a second end section fixed on the support carriage.

8. The seating furniture structure according to claim 7, wherein the forced coupling unit provides forced coupling of the tension cord control system to the pivot mechanism of the guiding part, in order to couple the pivot lever, bearing the deflection element adjacent to the support carriage, to the rocker in such a manner that the support carriage, with a downwards projecting pivot position of the guiding part relative to a ground, assumes a rear side end position displaced relative to the seat part arrangement.

9. The seating furniture structure according to claim 8, wherein the forced coupling unit comprises a control arm engaging the pivot lever and a double lever mounted on the carrier unit, wherein the control arm engages the double lever.

10. The seating furniture structure according to claim 9, wherein the double lever is coupled to the rocker of the tension cord control system by a transfer lever.

11. An item of seating furniture including a seating furniture structure according to claim 1.

* * * * *